US012000409B2

(12) United States Patent
Kim

(10) Patent No.: US 12,000,409 B2
(45) Date of Patent: Jun. 4, 2024

(54) TURBO COMPRESSOR WITH EXPLOSION-PROOF FUNCTION

(71) Applicant: TNE KOREA CO., LTD., Cheongju-si (KR)

(72) Inventor: Kyeong Su Kim, Daejeon (KR)

( * ) Notice: Subject to any disclaimer, the term of this patent is extended or adjusted under 35 U.S.C. 154(b) by 0 days.

(21) Appl. No.: 18/279,861

(22) PCT Filed: Jan. 21, 2022

(86) PCT No.: PCT/KR2022/001090

§ 371 (c)(1),
(2) Date: Aug. 31, 2023

(87) PCT Pub. No.: WO2022/203178

PCT Pub. Date: Sep. 29, 2022

(65) Prior Publication Data

US 2024/0151245 A1 May 9, 2024

(30) Foreign Application Priority Data

Mar. 23, 2021 (KR) ..... 10-2021-0037627

(51) Int. Cl.
*F04D 29/58* (2006.01)
*F04D 29/053* (2006.01)
*F04D 29/42* (2006.01)

(52) U.S. Cl.
CPC ..... *F04D 29/584* (2013.01); *F04D 29/053* (2013.01); *F04D 29/4206* (2013.01); *F04D 29/5826* (2013.01)

(58) Field of Classification Search
CPC .. F04D 29/584; F04D 29/053; F04D 29/4206; F04D 29/5826; F04D 25/082;
(Continued)

(56) References Cited

U.S. PATENT DOCUMENTS

2019/0323509 A1* 10/2019 Gashi ..... F04D 17/122

FOREIGN PATENT DOCUMENTS

| | | | |
|---|---|---|---|
| KR | 10-0572849 | B1 | 4/2006 |
| KR | 10-2013-0030392 | A | 3/2013 |
| KR | 10-2015-0007755 | A | 1/2015 |

* cited by examiner

*Primary Examiner* — Aaron R Eastman
(74) *Attorney, Agent, or Firm* — KORUS Patent, LLC; Seong Il Jeong

(57) ABSTRACT

Provided is a turbo compressor capable of compressing a gas and supplying the compressed gas to outside, the turbo compressor including a compression unit including an impeller for compressing a gas introduced through a compressed gas inlet, a motor including a rotating shaft having an end coupled to the impeller, to rotate the impeller, a housing including a motor accommodation space for accommodating the motor, a cooling air channel provided to pass through the motor accommodation space and formed to continuously circulate a cooling gas accommodated therein, one or more air bearings supporting a radial load or an axial load of the rotating shaft, and a non-contact explosion-proof unit provided as a passage through which flames produced in an inner space of the housing pass so as to be cooled and then discharged to the outside, and having a width less than or equal to a predetermined value and a length greater than or equal to a predetermined value, wherein a compressed gas channel is spatially separate from the cooling air channel to prevent the gas inside the compressed gas channel from penetrating into the cooling air channel. According to the present invention, an explosion-proof turbo compressor with an improved structure to increase service life and reduce vibration noise by using air bearings and to, at the same time, rapidly cool and then discharge flames caused by an internal explosion may be provided.

10 Claims, 7 Drawing Sheets

(58) Field of Classification Search
CPC ..... F04D 25/0613; H01M 8/04074; H01M 8/04029; H01M 50/143; H02K 5/136
See application file for complete search history.

TURBO COMPRESSOR WITH EXPLOSION-PROOF FUNCTION

TECHNICAL FIELD

The present invention relates to a turbo compressor, and more particularly, to an explosion-proof turbo compressor capable of increasing service life and reducing vibration noise by using air bearings and of, at the same time, rapidly cooling and then discharging flames caused by an internal explosion.

BACKGROUND ART

A turbo compressor or turbo blower is a centrifugal pump that sucks in and compresses external air or gas and then blows out the compressed air or gas by rotating an impeller at high speed, and is commonly used to transfer powder or for aeration at sewage treatment plants and also used for industrial processes and vehicles these days.

In the turbo compressor, high frictional heat is unavoidably produced by a motor and bearings to rotate an impeller at high speed and thus cooling of main heat sources such as the motor and the bearings is required.

An example of an existing turbo compressor is disclosed in Korean Patent Publication No. 10-2015-0007755. This turbo compressor has a structure in which a portion of compressed air produced by an impeller is used to cool a motor and bearings for rotating the impeller, and then is introduced back into the impeller through inner holes of a rotating shaft of the motor.

However, according to the existing turbo compressor, because a portion of the air compressed by the impeller is used as a cooling gas, pressure loss occurs in the air compressed by the impeller. In addition, because the cooling gas is heated by the motor and the bearings and then introduced back into the impeller, the air to be compressed by the impeller may increase in temperature and thus the compression efficiency of the turbo compressor may be additionally reduced.

To solve the above problems, a turbo compressor in which a compressed gas channel through which compressed air produced by an impeller passes is spatially separate from a cooling air channel through which a cooling gas passes, to prevent the gas inside the compressed gas channel from penetrating into the cooling air channel has been adopted.

Meanwhile, when an explosive gas is present in or near the turbo compressor, an explosion by flames due to burning of a motor stator or the friction of bearings inside the turbo compressor needs to be prevented and a turbo compressor with an explosion-proof function is required for this purpose.

Such an explosion-proof turbo compressor is required to satisfy a design requirement that flames produced from various flame sources inside the turbo compressor should not propagate to an explosive gas and cause an explosion, and existing explosion-proof turbo compressors generally use rolling bearings to support a rotating shaft and use explosion-proof sealing to prevent flames produced inside from propagating to the outside.

The existing explosion-proof sealing is "contact" sealing for sealing an inner space in contact with a rotating shaft and/or a motor housing, and the "contact" sealing exerts excellent sealing power but is not applicable to air bearings such as foil air bearings because vibration caused by rotation of the rotating shaft can be transmitted to the bearings.

DETAILED DESCRIPTION OF THE INVENTION

Technical Problem

The present invention provides an explosion-proof turbo compressor with an improved structure to increase service life and reduce vibration noise by using air bearings and to, at the same time, rapidly cool and then discharge flames caused by an internal explosion.

Technical Solution

According to an aspect of the present invention, there is provided a turbo compressor capable of compressing a gas and supplying the compressed gas to outside, the turbo compressor including a compressed gas inlet through which the gas is sucked in, an impeller for compressing the gas introduced through the compressed gas inlet, a compressed gas outlet through which the gas compressed by the impeller is discharged to the outside, a compression unit including a compressed gas channel connected from the compressed gas inlet to the compressed gas outlet, a motor including a rotating shaft having an end coupled to the impeller, to rotate the impeller, a housing including a motor accommodation space for accommodating the motor, a cooling air channel provided to pass through the motor accommodation space and formed to continuously circulate a cooling gas accommodated therein, one or more air bearings supporting a radial load or an axial load of the rotating shaft, and a non-contact explosion-proof unit provided as a passage through which flames produced in an inner space of the housing pass so as to be cooled and then discharged to the outside, and having a width less than or equal to a predetermined value and a length greater than or equal to a predetermined value, wherein the compressed gas channel is spatially separate from the cooling air channel to prevent the gas inside the compressed gas channel from penetrating into the cooling air channel.

The non-contact explosion-proof unit may connect the inner space of the housing and the compressed gas channel to each other.

The non-contact explosion-proof unit may be a cylindrical space formed by cooperation of a first surface provided on an outer circumferential surface of an end of the rotating shaft and a second surface provided on the housing.

The non-contact explosion-proof unit may be a conical space formed by cooperation of a first surface provided on an outer circumferential surface of an end of the rotating shaft and a second surface provided on the housing, and the conical space may be positioned within a predetermined distance from the impeller and has a radius gradually decreasing toward the impeller.

The non-contact explosion-proof unit may have a shape selected from a group including a stair shape and a wave shape, to increase a distance by which the flames produced in the inner space of the housing pass.

The turbo compressor may further include a cooling fan for forcibly circulating the cooling gas accommodated in the cooling air channel.

The cooling fan may be disposed at a rear end of the rotating shaft and rotated by torque of the rotating shaft.

Cooling fins capable of increasing efficiency of heat exchange may be provided between the compressed gas channel and the cooling air channel.

The turbo compressor may further include an electrical converter for controlling the motor, the electrical converter may include a case made of a metal material to airtightly accommodate internal heating elements, and the case may be maintained in contact with the housing to exchange heat.

Cooling fins capable of increasing efficiency of heat exchange may be provided between the compressed gas channel and the cooling air channel, and the case may be disposed at a position where heat is exchangeable with the cooling fins.

Advantageous Effects

According to the present invention, a turbo compressor capable of compressing a gas and supplying the compressed gas to outside includes a compression unit including an impeller for compressing a gas introduced through a compressed gas inlet, a motor including a rotating shaft having an end coupled to the impeller, to rotate the impeller, a housing including a motor accommodation space for accommodating the motor, a cooling air channel provided to pass through the motor accommodation space and formed to continuously circulate a cooling gas accommodated therein, one or more air bearings supporting a radial load or an axial load of the rotating shaft, and a non-contact explosion-proof unit provided as a passage through which flames produced in an inner space of the housing pass so as to be cooled and then discharged to the outside, and having a width less than or equal to a predetermined value and a length greater than or equal to a predetermined value, and a compressed gas channel is spatially separate from the cooling air channel to prevent the gas inside the compressed gas channel from penetrating into the cooling air channel. As such, service life may be increased and vibration noise may be reduced using the air bearings and, at the same time, even when an internal explosion occurs due to frames caused by burning of a motor stator, the friction of the bearings, or the like inside an inner housing, the flames may be cooled while passing through the non-contact explosion-proof unit and then discharged to the outside and thus explosion of the compressed gas may be prevented.

That is, according to the present invention, an explosion-proof turbo compressor having both the positive effects of air bearings and the positive effects of an explosion-proof turbo compressor may be provided.

BEST MODE

Hereinafter, the present invention will be described in detail by explaining embodiments of the invention with reference to the attached drawings.

Figure 1:
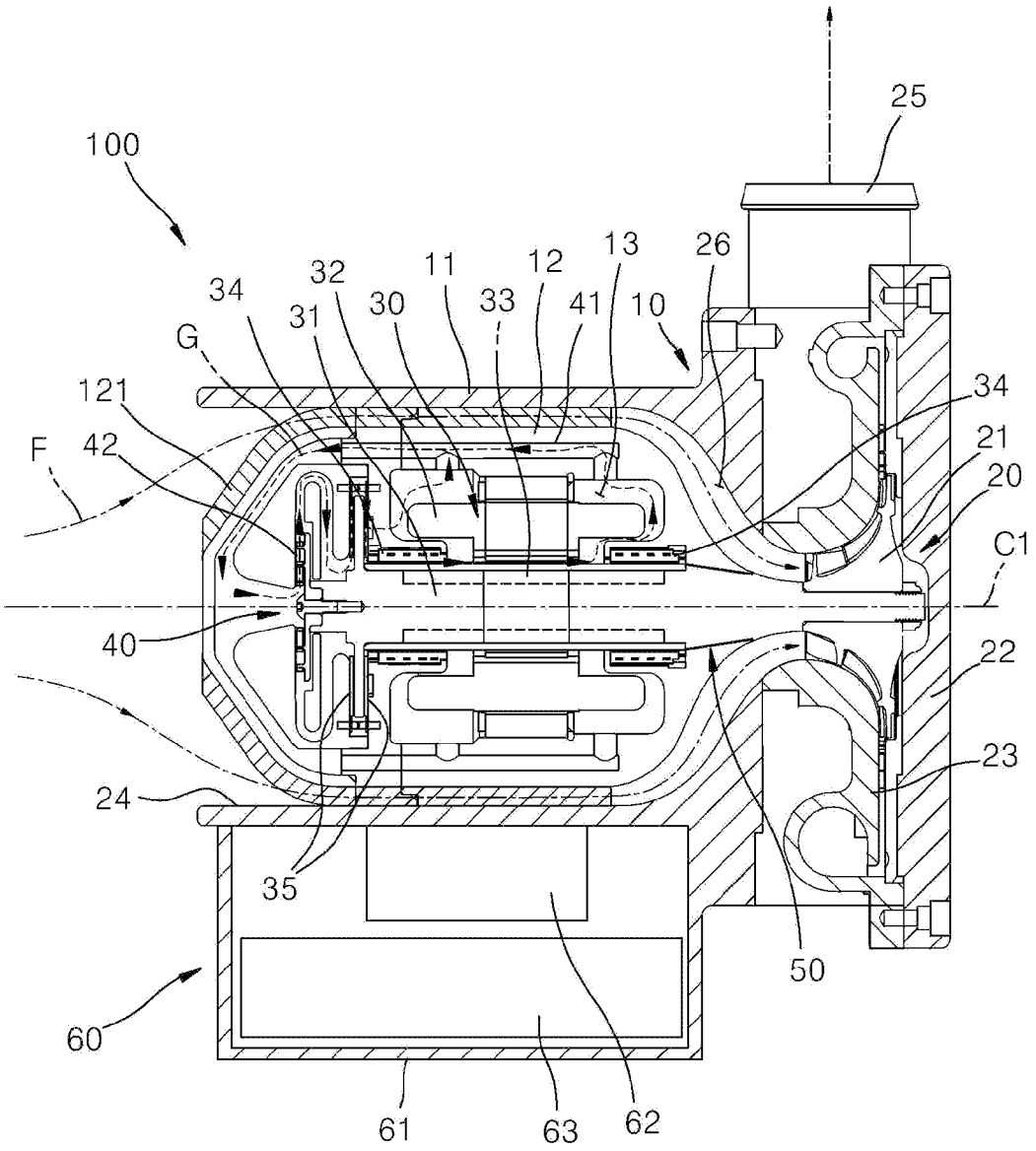
FIG. 1 is a cross-sectional view of a turbo compressor according to an embodiment of the present invention.
Figure 2:
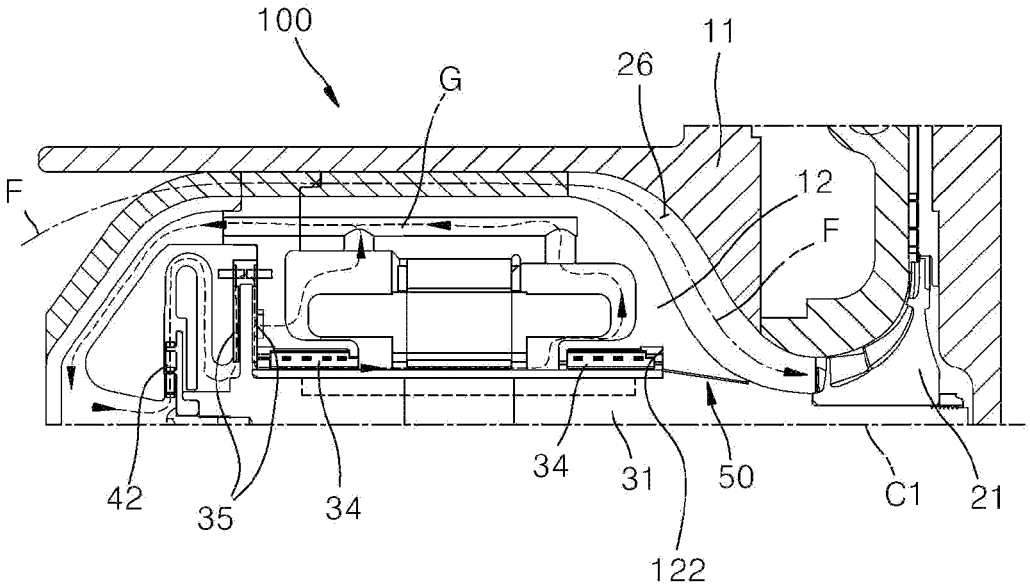
FIG. 2 is a partially enlarged view of the turbo compressor illustrated in FIG. 1.
Figure 3:
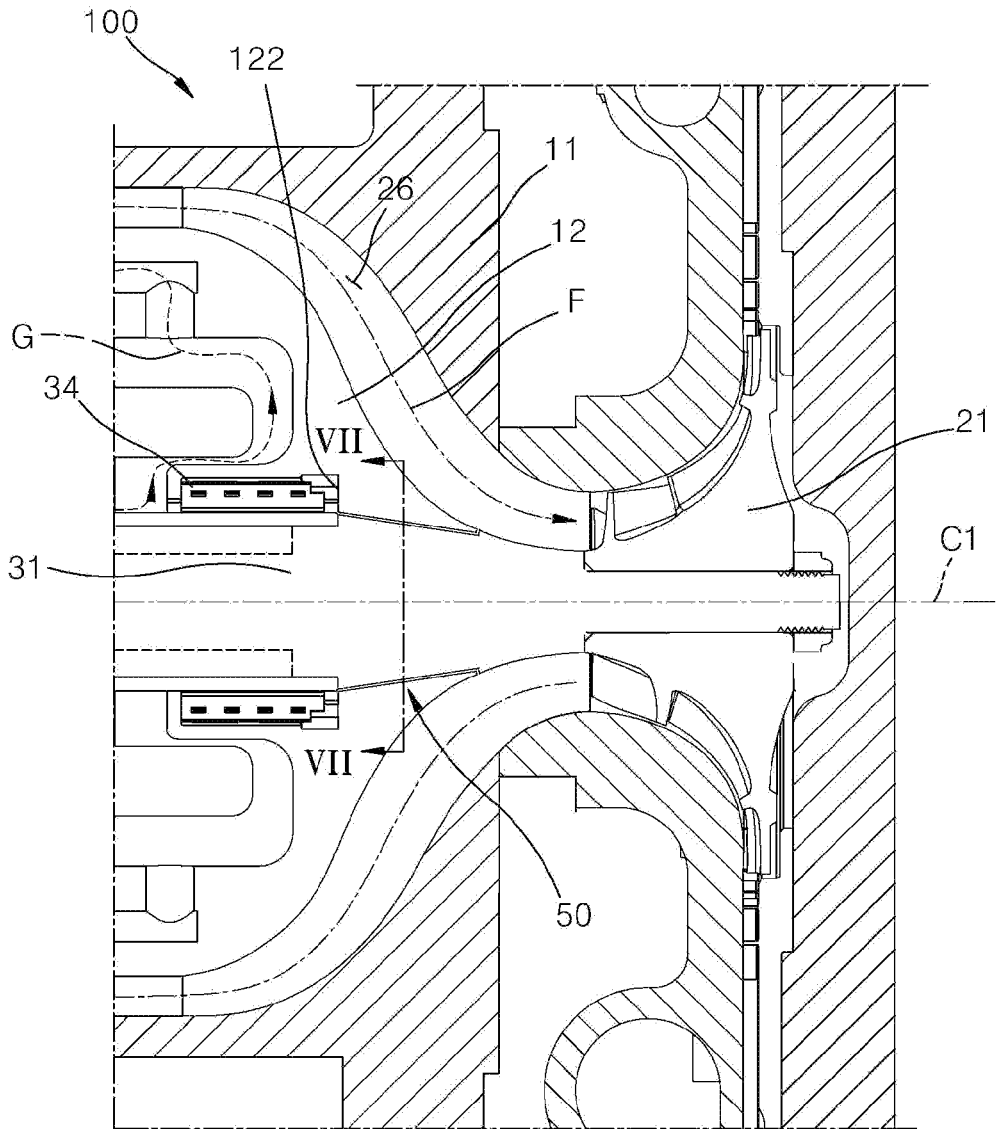
FIG. 3 is an enlarged view of the vicinity of an impeller of the turbo compressor illustrated in FIG. 1.

FIG. 1 is a cross-sectional view of a turbo compressor according to an embodiment of the present invention, and FIG. 2 is a partially enlarged view of the turbo compressor illustrated in FIG. 1. FIG. 3 is an enlarged view of the vicinity of an impeller of the turbo compressor illustrated in FIG. 1.

Referring to FIGS. 1 to 3, a turbo compressor 100 according to an embodiment of the present invention is a centrifugal pump that sucks in and compresses an external gas and then blows the compressed gas to the outside by rotating an impeller at high speed, and is also called a turbo compressor or a turbo blower. The turbo compressor 100 includes a housing 10, a compression unit 20, a motor 30, an air-cooling unit 40, a non-contact explosion-proof unit 50, and an electrical converter 60. The following description assumes that the gas to be compressed is air containing explosive substances.

The housing 10 is a housing made of a metal material and includes an outer housing 11 and an inner housing 12.

The outer housing 11 is a cylindrical member having a cross-section with a first central axis C1 as the center of a circle, and extends along the first central axis C1.

The inner housing 12 is a cylindrical member including a motor accommodation space 13, has a cross-section with the first central axis C1 as the center of a circle, and extends along the first central axis C1.

The motor accommodation space 13 is a space having a shape corresponding to the motor 30 described below to accommodate the motor 30.

The outer housing 11 has a shape corresponding to the inner housing 12 to surround and accommodate the inner housing 12.

As shown in FIG. 1, the outer housing 11 has an open left end and a right end coupled to a rear cover 23 of the compression unit 20 described below.

An inner surface of the outer housing 11 and an outer surface of the inner housing 12 are spaced apart from each other by a predetermined distance and face each other.

In the current embodiment, as shown in FIG. 1, a compressed gas channel 26 described below is formed between the inner surface of the outer housing 11 and the outer surface of the inner housing 12.

At the left end of the outer housing 11, a compressed gas inlet 24 through which external air is sucked into the compressed gas channel 26 is formed.

The compressed gas inlet 24 is a circular ring-shaped hole formed by cooperation of the inner surface of the outer housing 11 and the outer surface of the inner housing 12.

Cooling fins 121 capable of increasing the efficiency of heat exchange are provided on an outer circumferential surface of the inner housing 12.

The cooling fins 121 are cooling fins for increasing the efficiency of heat exchange between a cooling gas G flowing along a cooling air channel 41 provided in the inner housing 12, and a compressed gas F flowing along the compressed gas channel 26.

The cooling fins 121 protrude from the outer circumferential surface of the inner housing 12 in a radial direction of the inner housing 12 and extend along the first central axis C1.

A plurality of cooling fins 121 are spaced apart from each other along a circumferential direction of the inner housing 12.

As shown in FIG. 1, portions of ends of the cooling fins 121 are in contact with the inner surface of the outer housing 11.

Therefore, the compressed gas channel 26 is spatially separated into a plurality of channels along a circumferential direction of the first central axis C1 by the cooling fins 121.

In the motor accommodation space 13, one or more bearing mounting portions 122 are provided to mount journal bearings 34 and thrust bearings 35 described below.

In the current embodiment, the inner housing 12 has a substantially airtight structure in which a gas inside does not leak to the outside, except for a portion through which a rotating shaft 31 described below passes and a portion where the non-contact explosion-proof unit 50 is provided.

The compression unit 20 is a device for sucking in and compressing external air, and includes an impeller 21, a front cover 22, and the rear cover 23.

The impeller 21 is a main element of the centrifugal pump, is a wheel including a plurality of curved blades, and is mounted to rotate at high speed.

The front cover 22 is a metal member disposed in front of the impeller 21 and is provided to cover a front end of the rotating shaft 31 described below.

The rear cover 23 is a metal member disposed behind the impeller 21 and is coupled to the housing 10 by a bolt or a screw. In the current embodiment, the rear cover 23 is coupled to the outer housing 11.

The rear cover 23 is provided in the form of a scroll case including channels through which the air having passed through the impeller 21 may flow in a spiral shape.

The impeller 21 compresses the air introduced through the compressed gas inlet 24, and the air compressed by the impeller 21 is discharged to the outside through a compressed gas outlet 25 as shown in FIG. 1.

The air sucked into the compressed gas inlet 24 is compressed while moving along the compressed gas channel 26 connected from the compressed gas inlet 24 to the compressed gas outlet 25.

The motor 30 is an electric motor for generating torque and is a device for supplying high-speed torque to the impeller 21. The motor 30 includes the rotating shaft 31, a stator 32, a rotor 33, and bearings 34.

The rotating shaft 31 is a rod member extending along the first central axis C1, and a front end thereof is relatively non-rotatably coupled to the impeller 21 to rotate the impeller 21.

At a rear end of the rotating shaft 31, a thrust bearing runner (not denoted by a reference numeral) to which the thrust bearings 35 described below are couplable is provided.

The stator 32 is a stator wound with a field coil and is fixed and mounted in the motor accommodation space 13.

The rotor 33 is a rotor including a permanent magnet and is coupled to a middle portion of the rotating shaft 31.

The journal bearings 34 are journal foil air bearings rotatably supporting the rotating shaft 31 to reduce frictional force caused by high-speed rotation.

The journal bearings 34 support a radial load of the rotating shaft 31 and are provided at the front and rear ends of the rotating shaft 31.

A pair of thrust bearings 35 are mounted at the rear end of the rotating shaft 31. In the current embodiment, thrust foil air bearings are used as the thrust bearings 35.

The thrust bearings 35 are bearings for supporting an axial load of the rotating shaft 31 and, in the current embodiment, as shown in FIG. 1, a pair of thrust bearings 35 are disposed on both surfaces of the thrust bearing runner (not denoted by a reference numeral).

Predetermined gaps are present between the stator 32 and the rotor 33, between the rotating shaft 31 and the stator 32, between the rotating shaft 31 and the journal bearings 34, between the thrust bearings 35 and the thrust bearing runner (not denoted by a reference numeral) of the rotating shaft 31.

The air-cooling unit 40 is a device for cooling the inner housing 12 and the motor 30 by using a cooling gas and includes the cooling air channel 41 and a cooling fan 42. Herein, air or an inert gas is used as the cooling gas.

The cooling air channel 41 is a passage for accommodating the cooling gas and is formed to continuously circulate the cooling gas G accommodated therein.

As shown in FIG. 2, the cooling air channel 41 is provided to continuously circulate the entire space of the motor accommodation space 13.

The cooling air channel 41 may be provided to be rotationally or axially symmetric about the first central axis C1.

In the current embodiment, the cooling air channel 41 is spatially separate from the compressed gas channel 26. Therefore, the gas inside the compressed gas channel 26 may not leak from the compressed gas channel 26 or penetrate into the cooling air channel 41 while being compressed.

The cooling fan 42 is a cooling fan for forcibly circulating the cooling gas accommodated in the cooling air channel 41 and is mounted at a rear end of the motor accommodation space 13.

In the current embodiment, the cooling fan 42 is relatively non-rotatably coupled to the rear end of the rotating shaft 31 and thus rotated together by torque of the rotating shaft 31.

Figure 4:
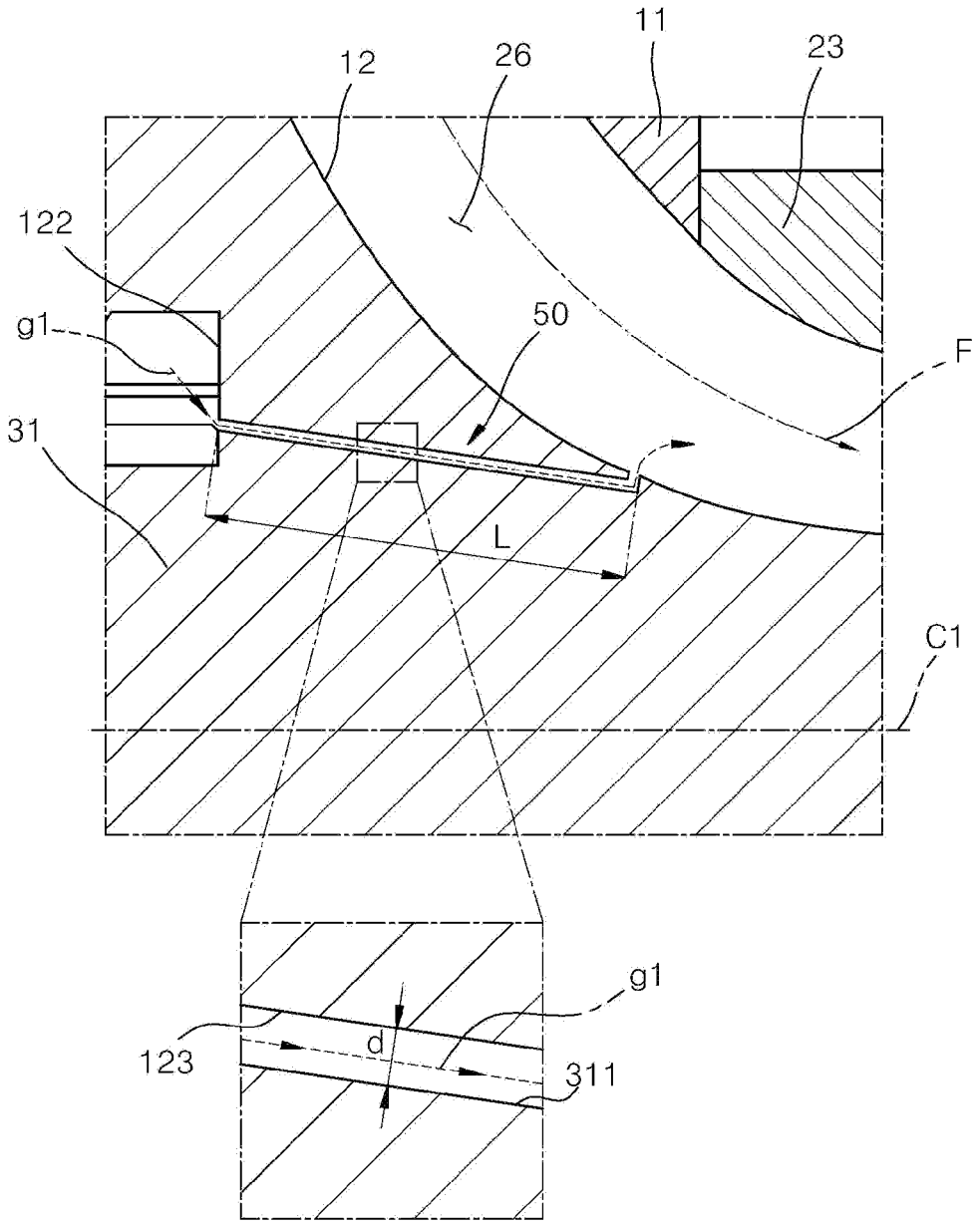
FIG. 4 is an enlarged view of a non-contact explosion-proof unit illustrated in FIG. 1.

As shown in FIG. 4, the non-contact explosion-proof unit 50 is a device through which flames g1 produced in an inner space of the inner housing 12 pass so as to be cooled and then discharged to the outside.

In the current embodiment, as shown in FIG. 4, the non-contact explosion-proof unit 50 is provided in the form of a gap or passage having a width d less than or equal to a predetermined value and a length L greater than or equal to a predetermined value.

The non-contact explosion-proof unit 50 is provided to have an axially or rotationally symmetric shape so as not to interfere with rotary motion of the rotating shaft 31.

Figure 7:
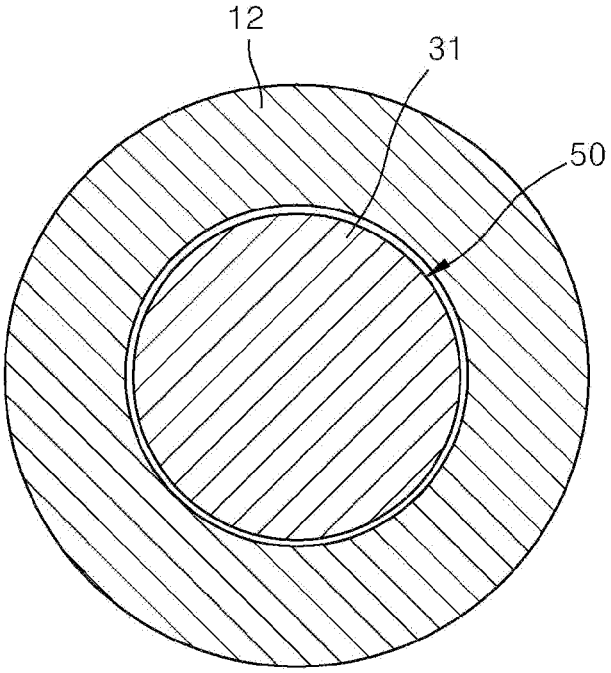
FIG. 7 is a cross-sectional view taken along line VII-VII of the turbo compressor illustrated in FIG. 3 of the present invention.

In the current embodiment, as shown in FIGS. 4 and 7, the non-contact explosion-proof unit 50 is provided as a conical space formed by cooperation of a first surface 311 provided on an outer circumferential surface of an end of the rotating shaft 31 and a second surface 123 provided on the inner housing 12.

Because the first surface 311 of the rotating shaft 31 and the second surface 123 of the inner housing 12 are spaced from each other by a predetermined distance d, even when the rotating shaft 31 rotates, the first and second surfaces 311 and 123 are always maintained in a "non-contact" state.

In the current embodiment, the first surface 311 of the rotating shaft 31 is a tapered curved surface positioned at the front end of the rotating shaft 31 and having a radius gradually decreasing toward the impeller 21. The second surface 123 of the inner housing 12 is a tapered curved surface having a shape corresponding to the first surface 311.

Therefore, the conical space of the non-contact explosion-proof unit 50 is positioned within a predetermined distance from the impeller 21 and has a radius gradually decreasing toward the impeller 21.

An end of the non-contact explosion-proof unit 50 is connected to a bearing mounting portion 122 in which one of the journal bearings 34 disposed at a front end of the motor accommodation space 13 is mounted, and another end of the non-contact explosion-proof unit 50 is connected to a downstream side of the compressed gas channel 26. Herein, the downstream side of the compressed gas channel 26 refers to a position immediately before the compressed gas F enters the impeller 21.

Therefore, in the current embodiment, the non-contact explosion-proof unit 50 connects the inner space of the inner housing 12 and the compressed gas channel 26 to each other.

The electrical converter 60 is a device for converting electricity to control the motor 30, and converts a direct current (DC) component into an alternating current (AC) component or converts an AC component into a DC component and supplies the converted component to the motor 30.

In the current embodiment, the electrical converter 60 includes an inverter for converting a DC component into an AC component. Herein, the inverter is also called a power inverter, and obtains desired voltage and frequency output values through an appropriate conversion method, switching element, or control circuit.

The electrical converter 60 includes a case 61 made of a metal material to accommodate various heating elements.

The case 61 has an airtight structure to prevent leakage of flames caused by burning of various internal heating elements.

In the current embodiment, the case 61 is disposed under the outer housing 11 and maintained in contact with an outer circumferential surface of the outer housing 11 as shown in FIG. 1 to exchange heat with the housing 10.

In the current embodiment, as shown in FIG. 1, the case 61 is disposed at a position where heat is exchangeable with ends of the cooling fins 121 through the outer housing 11.

A switching module 62 is disposed in an upper portion of the case 61, and a controller 63 is disposed in a lower portion of the case 61.

The switching module 62 is a main heating element of the electrical converter 60 and includes an insulated/isolated gate bipolar transistor (IGBT).

The controller 63 is a device for controlling overall operation of the motor 30, e.g., a rotational speed of the motor 30.

An example of a method of operating the above-described turbo compressor 100 will now be described.

When the rotating shaft 31 of the motor 30 rotates, the impeller 21 and the cooling fan 42 rotate and the air F introduced through the compressed gas inlet 24 is compressed while flowing along the compressed gas channel 26 of the compression unit 20 and discharged to the outside through the compressed gas outlet 25. In this case, because the compressed gas channel 26 is spatially separate from the cooling air channel 41, the air flowing inside the compressed gas channel 26 may not leak or penetrate into the cooling air channel 41 while being compressed. That is, the air F flowing along the compressed gas channel 26 and the cooling gas G flowing along the cooling air channel 41 do not interfere with each other.

As shown in FIG. 2, the cooling gas G accommodated in the cooling air channel 41 is forcibly circulated by the cooling fan 42 to pass through the field coil of the stator 32, the rotating shaft 31, the rotor 33, the journal bearings 34, and the thrust bearings 35.

In this case, the cooling gas G flowing along the edge of the motor accommodation space 13 is rapidly cooled by the compressed gas F flowing between the outer housing 11 and the inner housing 12. Particularly, by the cooling fins 121, the efficiency of heat exchange between the compressed gas F and the cooling gas G flowing along the edge of the motor accommodation space 13 is greatly increased.

Meanwhile, when an internal explosion occurs due to frames caused by burning of the motor stator 32, the friction of the bearings 34 and 35, or the like inside the inner housing 12 while the turbo compressor 100 is operating, as shown in FIG. 4, the flames g1 flow into the end of the non-contact explosion-proof unit 50, pass through the non-contact explosion-proof unit 50, and are discharged through the other end of the non-contact explosion-proof unit 50.

In this case, because the flames g1 produced in the inner space of the inner housing 12 are cooled while passing through the non-contact explosion-proof unit 50 and then discharged to the outside, even when the flames g1 join the compressed gas F, the compressed gas F does not explode.

The above-described turbo compressor 100 is a turbo compressor capable of compressing a gas and supplying the compressed gas to the outside, and includes the compressed gas inlet 24 through which the gas is sucked in, the impeller 21 for compressing the gas introduced through the compressed gas inlet 24, the compressed gas outlet 25 through which the gas compressed by the impeller 21 is discharged to the outside, the compression unit 20 including the compressed gas channel 26 connected from the compressed gas inlet 24 to the compressed gas outlet 25, the motor 30 including the rotating shaft 31 having an end coupled to the impeller 21, to rotate the impeller 21, the housing 10 including the motor accommodation space 13 for accommodating the motor 30, the cooling air channel 41 provided to pass through the motor accommodation space 13 and formed to continuously circulate the cooling gas G accommodated therein, one or more air bearings 34 and 35 supporting a radial load or an axial load of the rotating shaft 31, and the non-contact explosion-proof unit 50 provided as a passage through which flames produced in an inner space of the housing 10 pass so as to be cooled and then discharged to the outside, and having the width d less than or equal to a predetermined value and the length L greater than or equal to a predetermined value, and the compressed gas channel 26 is spatially separate from the cooling air channel 41 to prevent the gas inside the compressed gas channel 26 from penetrating into the cooling air channel 41. As such, service life may be increased and vibration noise may be reduced using the air bearings 34 and 35 and, at the same time, even when an internal explosion occurs due to frames caused by burning of the motor stator 32, the friction of the bearings 34 and 35, or the like inside the inner housing 12, the flames g1 may be cooled while passing through the non-contact explosion-proof unit 50 and then discharged to the outside and thus explosion of the compressed gas F may be prevented.

In the turbo compressor 100, the non-contact explosion-proof unit 50 connects the inner space 13 of the housing and the compressed gas channel 26 to each other. As such, the flames g1 passing through the non-contact explosion-proof unit 50 may be accelerated by a negative pressure produced by the compressed gas F flowing through the compressed gas channel 26.

In the turbo compressor 100, the non-contact explosion-proof unit 50 is a conical space 50 formed by cooperation of the first surface 311 provided on the outer circumferential surface of the end of the rotating shaft 31 and the second surface 123 provided on the housing 10, and the conical space 50 is positioned within a predetermined distance from the impeller 21 and has a radius gradually decreasing toward the impeller 21. As such, considering that the front end of the rotating shaft 31 generally has a tapered shape, machining for forming the non-contact explosion-proof unit 50 may be minimized compared to a case of machining another portion of the inner housing 12.

The turbo compressor 100 further includes the cooling fan 42 for forcibly circulating the cooling gas G accommodated in the cooling air channel 41. As such, the cooling gas G accommodated in the cooling air channel 41 may be forcibly circulated.

In the turbo compressor 100, the cooling fan 42 is disposed at the rear end of the rotating shaft 31 and rotated by torque of the rotating shaft 31. As such, an additional motor for rotating the cooling fan 42 may not be required.

In the turbo compressor 100, the cooling fins 121 capable of increasing the efficiency of heat exchange are provided between the compressed gas channel 26 and the cooling air channel 41. As such, the efficiency of heat exchange between the cooling gas G and the compressed gas F may be increased.

The turbo compressor 100 further includes the electrical converter 60 for controlling the motor 30, the electrical converter 60 includes the case 61 made of a metal material to airtightly accommodate internal heating elements, and the case 61 is maintained in contact with the housing 10 to exchange heat. As such, even when burning or an explosion occurs in the case 61, flames may not leak out and, at the same time, the heating elements in the case 61 may be rapidly cooled.

In the turbo compressor 100, wherein the cooling fins 121 capable of increasing the efficiency of heat exchange are provided between the compressed gas channel 26 and the cooling air channel 41, and the case 61 is disposed at a position where heat is exchangeable with the cooling fins 121. As such, the electrical converter 60 may be more rapidly cooled by the compressed gas F flowing between the cooling fins 121.

Figure 5:
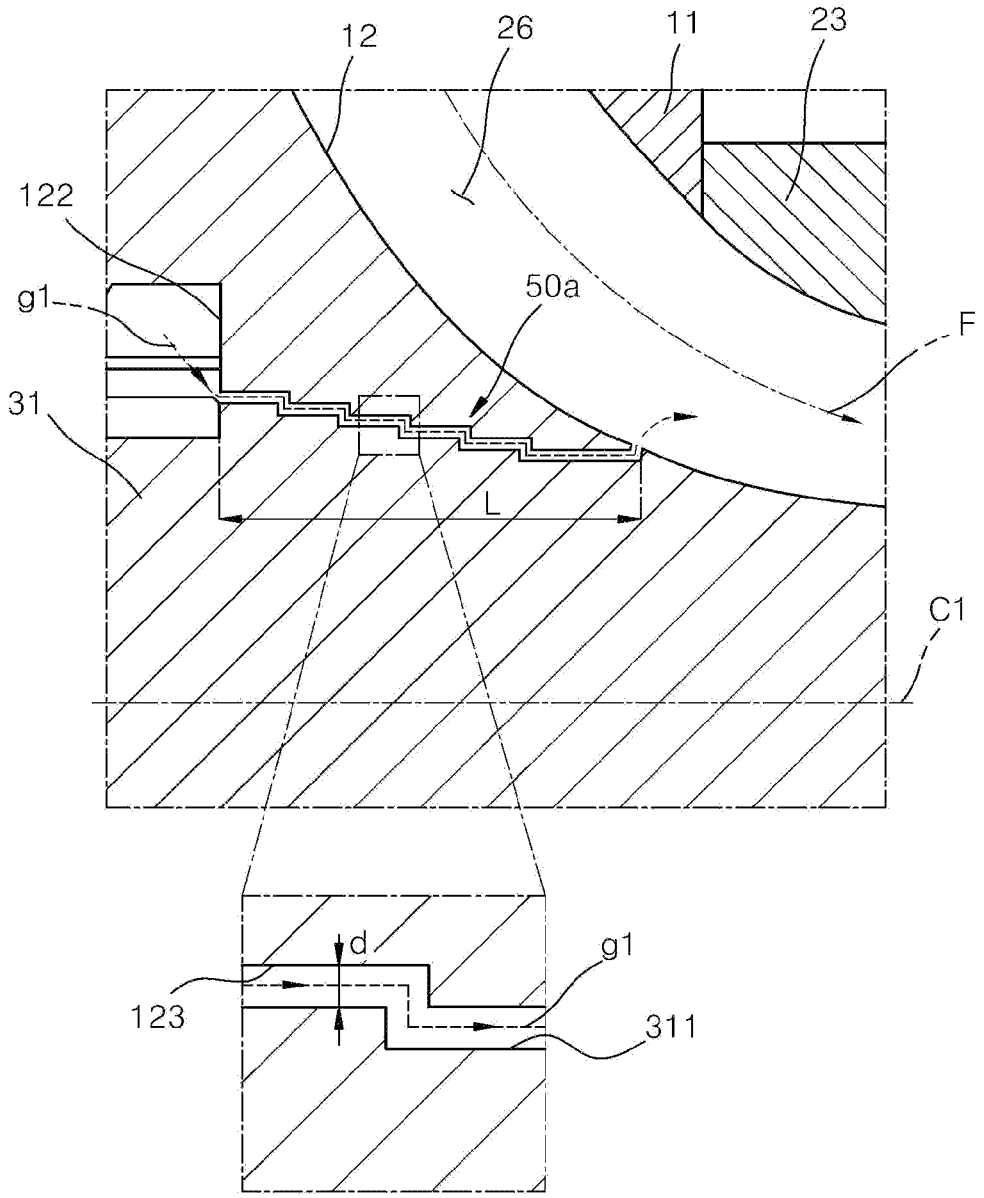
FIG. 5 is an enlarged view of a non-contact explosion-proof unit according to a second embodiment.
Figure 6:
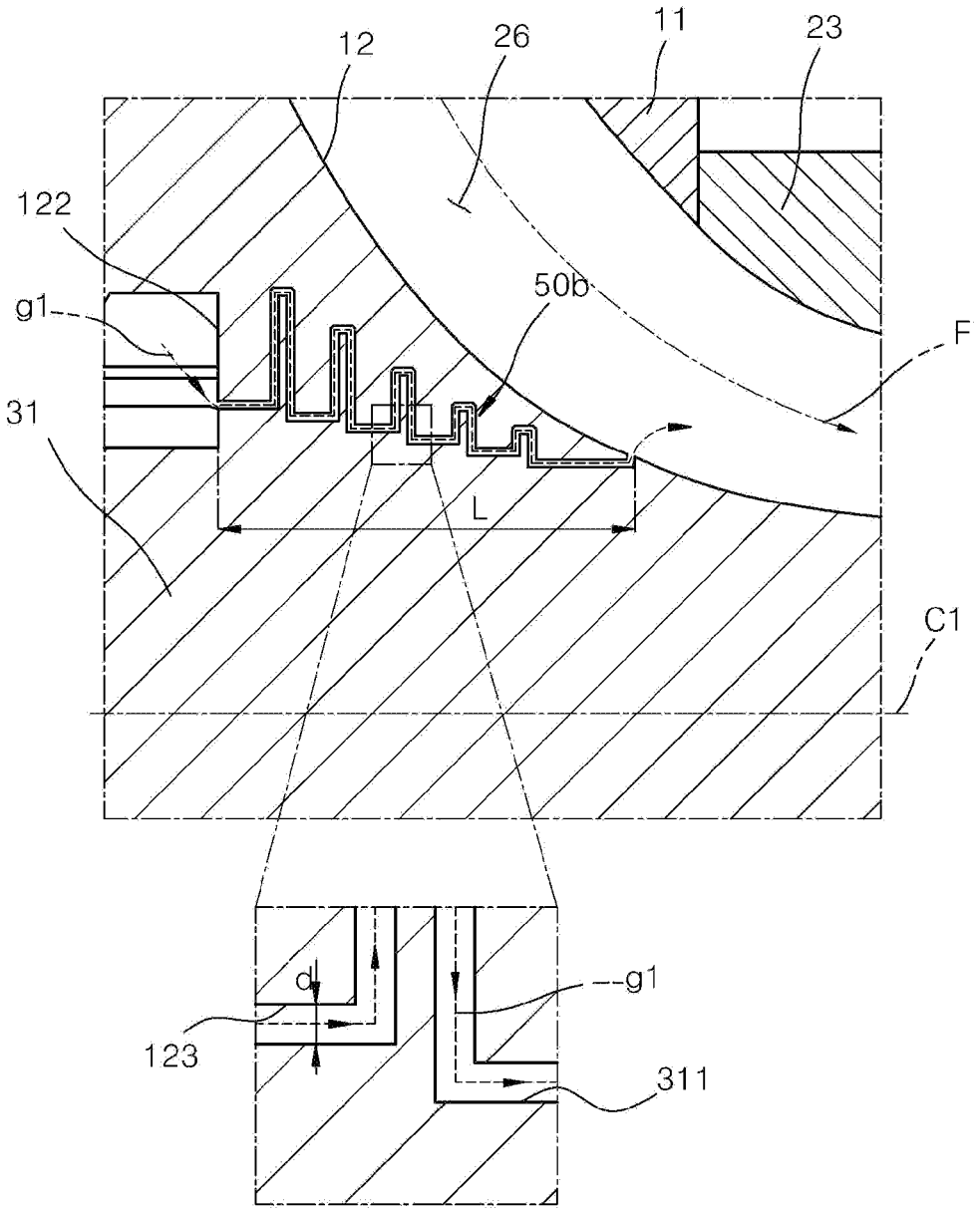
FIG. 6 is an enlarged view of a non-contact explosion-proof unit according to a third embodiment.

Although the non-contact explosion-proof unit 50 is provided in a "linear" shape as shown in FIG. 4 in the current embodiment, instead of such a shape, in order to substantially increase a distance by which the flames g1 produced in the inner space of the housing 10 pass, a step-shaped non-contact explosion-proof unit 50*a* illustrated in FIG. 5 of a wave-shaped non-contact explosion-proof unit 50*b* illustrated in FIG. 6 may also be used. Herein, in addition to the shapes of the non-contact explosion-proof units 50*a* and 50*b*, the non-contact explosion-proof unit 50 may have any shape as long as the distance by which the flames g1 pass may be substantially increased and the first and second surfaces 311 and 123 may be maintained in a "non-contact" state even when the rotating shaft 31 rotates.

Although the non-contact explosion-proof unit 50 is provided as a conical space formed by cooperation of the first surface 311 provided on the outer circumferential surface of the end of the rotating shaft 31 and the second surface 123 provided on the inner housing 12 as shown in FIGS. 4 and 7 in the current embodiment, instead, the non-contact explosion-proof unit 50 may be a cylindrical space formed by cooperation of the first surface 311 provided on the outer circumferential surface of the end of the rotating shaft 31 and the second surface 123 provided on the housing 10.

Although the non-contact explosion-proof unit 50 connects the inner space of the inner housing 12 and the compressed gas channel 26 to each other in the current embodiment, the non-contact explosion-proof unit 50 may connect the inner space of the inner housing 12 and the outside of the outer housing 11 to each other.

Although the non-contact explosion-proof unit 50 connects the bearing mounting portion 122 of the journal bearing 34 disposed at the front end of the motor accommodation space 13 to the downstream side of the compressed gas channel 26 in the current embodiment, the non-contact explosion-proof unit 50 may connect an arbitrary point of the motor accommodation space 13 and an arbitrary point of the compressed gas channel 26 to each other.

Although the non-contact explosion-proof unit 50 is provided as a conical space formed 360 degrees along the circumferential direction of the first central axis C1 as shown in FIG. 7 in the current embodiment, spaces may be formed intermittently along parts of the circumferential direction of the first central axis C1 and no spaces may be formed along the other portions thereof in an alternate manner.

Although the cooling fan 42 is directly coupled to the rear end of the rotating shaft 31 in the current embodiment, the cooling fan 42 may be driven by a separate electric motor.

A sealing means for airtightness is not described in the current embodiment, various types of sealing means may be used.

While the present invention has been particularly shown and described with reference to embodiments thereof, it will be understood by one of ordinary skill in the art that various changes in form and details may be made therein without departing from the scope of the present invention as defined by the following claims.

The invention claimed is:

1. A turbo compressor capable of compressing a gas and supplying the compressed gas to outside, the turbo compressor comprising:

a compressed gas inlet through which the gas is sucked in;

an impeller for compressing the gas introduced through the compressed gas inlet;

a compressed gas outlet through which the gas compressed by the impeller is discharged to the outside;

a compression unit comprising a compressed gas channel connected from the compressed gas inlet to the compressed gas outlet;

a motor comprising a rotating shaft having an end coupled to the impeller, to rotate the impeller;

a housing comprising a motor accommodation space for accommodating the motor;

a cooling air channel provided to pass through the motor accommodation space and formed to continuously circulate a cooling gas accommodated therein;

one or more air bearings supporting a radial load or an axial load of the rotating shaft; and a non-contact explosion-proof unit provided as a passage through which flames produced in an inner space of the housing pass so as to be cooled and then discharged to the outside, and having a width less than or equal to a predetermined value and a length greater than or equal to a predetermined value, wherein the compressed gas channel is spatially separate from the cooling air channel to prevent the gas inside the compressed gas channel from penetrating into the cooling air channel.

2. The turbo compressor of claim 1, wherein the non-contact explosion-proof unit connects the inner space of the housing and the compressed gas channel to each other.

3. The turbo compressor of claim 1, wherein the non-contact explosion-proof unit is a cylindrical space formed by cooperation of a first surface provided on an outer circumferential surface of an end of the rotating shaft and a second surface provided on the housing.

4. The turbo compressor of claim 1, wherein the non-contact explosion-proof unit is a conical space formed by cooperation of a first surface provided on an outer circumferential surface of an end of the rotating shaft and a second surface provided on the housing, and wherein the conical space is positioned within a predetermined distance from the impeller and has a radius gradually decreasing toward the impeller.

5. The turbo compressor of claim 1, wherein the non-contact explosion-proof unit has a shape selected from a group comprising a stair shape and a wave shape, to increase a distance by which the flames produced in the inner space of the housing pass.

6. The turbo compressor of claim 1, further comprising a cooling fan for forcibly circulating the cooling gas accommodated in the cooling air channel.

7. The turbo compressor of claim 6, wherein the cooling fan is disposed at a rear end of the rotating shaft and rotated by torque of the rotating shaft.

8. The turbo compressor of claim 1, wherein cooling fins capable of increasing efficiency of heat exchange are provided between the compressed gas channel and the cooling air channel.

9. The turbo compressor of claim 1, further comprising an electrical converter for controlling the motor, wherein the electrical converter comprises a case made of a metal material to airtightly accommodate internal heating elements, and wherein the case is maintained in contact with the housing to exchange heat.

10. The turbo compressor of claim 9, wherein cooling fins capable of increasing efficiency of heat exchange are provided between the compressed gas channel and the cooling air channel, and wherein the case is disposed at a position where heat is exchangeable with the cooling fins.

* * * * *